US012479560B1

(12) United States Patent
Ward et al.

(10) Patent No.: US 12,479,560 B1
(45) Date of Patent: Nov. 25, 2025

(54) MARINE PROPULSION SYSTEM AND CONTROL METHOD

(71) Applicant: Brunswick Corporation, Mettawa, IL (US)

(72) Inventors: Aaron J. Ward, Oshkosh, WI (US); David J. Belter, Oshkosh, WI (US); Matthew W. Snyder, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 574 days.

(21) Appl. No.: 18/153,499

(22) Filed: Jan. 12, 2023

(51) Int. Cl.
*B63H 25/42* (2006.01)
*B63H 21/21* (2006.01)

(52) U.S. Cl.
CPC ..... *B63H 25/42* (2013.01); *B63H 2021/216* (2013.01)

(58) Field of Classification Search
CPC ..... B63H 25/42; B63H 2021/216
See application file for complete search history.

(56) References Cited

U.S. PATENT DOCUMENTS 6,234,853 B1 5/2001 Lanyi et al.
7,398,742 B1 7/2008 Gonring
7,467,595 B1 12/2008 Lanyi et al.
9,039,468 B1 5/2015 Arbuckle et al.
10,926,855 B2 2/2021 Derginer et al.
11,091,243 B1 8/2021 Gable et al.
11,130,554 B1 9/2021 Alby et al.
11,247,753 B2 2/2022 Arbuckle et al.
11,358,698 B1 6/2022 Snyder et al.
2022/0266971 A1 8/2022 Kraus et al.
2022/0266972 A1 8/2022 Novak et al.
2022/0306257 A1* 9/2022 Afman ..... B63H 20/12

FOREIGN PATENT DOCUMENTS

JP 2024060162 A * 5/2024 ..... B63H 21/213

* cited by examiner

*Primary Examiner* — Anthony D Wiest
(74) *Attorney, Agent, or Firm* — Andrus Intellectual Property Law, LLP

(57) ABSTRACT

A method of controlling a marine propulsion system is provided wherein the marine propulsion system includes at least one rear marine drive steerable to a range of steering positions. The method includes receiving a propulsion demand input. For each of the at least one rear marine drive, a propeller direction and a commanded steering position are determined based on the propulsion demand input, a steering actuator is controlled to steer the rear marine drive toward the commanded steering position, a delayed time to begin propeller engagement is determined to coordinate initiation of propeller rotation with the rear marine drive reaching the commanded steering position. The rear marine drive is then controlled to begin rotating the propeller in the propeller direction based on the delayed time to generate the surge movement, the sway movement, and/or the yaw movement commanded.

24 Claims, 12 Drawing Sheets

YAW WITH ONLY REAR DRIVES

LATERAL DRIVE DECREASES TOTAL YAW

YAW WITH ONLY LATERAL DRIVE

LATERAL DRIVE INCREASES TOTAL YAW

LATERAL DRIVE INCREASES TOTAL YAW

LATERAL DRIVE CANCELS YAW

LATERAL DRIVE CANCELS YAW

SWAY WITH BOTH DRIVES

SWAY WITH BOTH DRIVES

MARINE PROPULSION SYSTEM AND CONTROL METHOD

FIELD

The present disclosure generally relates to methods and systems for propelling marine vessels, and more particularly to systems and methods for controlling steering and forward/reverse propeller direction for rear marine drives that are steerable to a wide range of steering positions.

BACKGROUND

Many different types of marine drives are well known to those skilled in the art. For example, steerable marine drives mounted to the rear of the vessel, such as outboard motors that are attached to the transom of a marine vessel and stern drive systems that extend in a rearward direction from the stern of a marine vessel, may sometimes be provided in groups of two or more and separately steerable to enable surge, sway, and yaw directional control, sometimes referred to as joysticking. The steerable marine drives are each steerable about their steering axis to a range of steering angles, which is effectuated by a steering actuator. Lateral marine drives may be positioned and/or configured to exert lateral force on the marine vessel, such as bow thrusters or drives that are steerable to a 90 degree angle with respect to a longitudinal centerline of the vessel. Marine drives generally comprise a powerhead, such as an electric motor or an internal combustion engine, driving rotation of a drive shaft that is directly or indirectly connected to a propeller on a propeller shaft and that imparts rotation thereto.

The following U.S. patents, publications, and applications are incorporated herein by reference, in entirety:

U.S. Pat. No. 6,234,853 discloses a docking system that utilizes the marine propulsion unit of a marine vessel, under the control of an engine control unit that receives command signals from a joystick or push button device, to respond to a maneuver command from the marine operator. The docking system does not require additional marine drives other than those normally used to operate the marine vessel under normal conditions. The docking or maneuvering system of the present invention uses two marine propulsion units to respond to an operator's command signal and allows the operator to select forward or reverse commands in combination with clockwise or counterclockwise rotational commands either in combination with each other or alone.

U.S. Pat. No. 7,398,742 discloses a steering assist system providing differential thrusts by two or more marine drives in order to create a more effective turning moment on a marine vessel. The differential thrusts can be selected as a function of the magnitude of turn commanded by an operator of the marine vessel and, in addition, as a function of the speed of the marine vessel at the time when the turning command is received.

U.S. Pat. No. 7,467,595 discloses a method for controlling the movement of a marine vessel that rotates one of a pair of marine drives and controls the thrust magnitudes of two marine drives. A joystick is provided to allow the operator of the marine vessel to select port-starboard, forward-reverse, and rotational direction commands that are interpreted by a controller which then changes the angular position of at least one of a pair of marine drives relative to its steering axis.

U.S. Pat. No. 9,039,468 discloses a system that controls speed of a marine vessel that includes first and second marine drives that produce first and second thrusts to propel the marine vessel. A control circuit controls orientation of the marine drives between an aligned position in which the thrusts are parallel and an unaligned position in which the thrusts are non-parallel. A first user input device is moveable between a neutral position and a non-neutral detent position. When the first user input device is in the detent position and the marine drives are in the aligned position, the thrusts propel the marine vessel in a desired direction at a first speed. When a second user input device is actuated while the first user input device is in the detent position, the marine drives move into the unaligned position and propel the marine vessel in the desired direction at a second, decreased speed without altering the thrusts.

U.S. Pat. No. 10,926,855 discloses a method for controlling low-speed propulsion of a marine vessel powered by a marine propulsion system having a plurality of propulsion devices that includes receiving a signal indicating a position of a manually operable input device movable to indicate desired vessel movement within three degrees of freedom, and associating the position of the manually operable input device with a desired inertial velocity of the marine vessel. A steering position command and an engine command are then determined for each of the plurality of propulsion devices based on the desired inertial velocity and the propulsion system is controlled accordingly. An actual velocity of the marine vessel is measured and a difference between the desired inertial velocity and the actual velocity is determined, where the difference is used as feedback in subsequent steering position command and engine command determinations.

U.S. Pat. No. 11,091,243 discloses a propulsion system on a marine vessel that includes at least one steerable propulsion device and at least one lateral thruster. A steering wheel is mechanically connected to and operable by a user to steer the at least one propulsion device. A user interface device is operable by a user to provide at least a lateral thrust command to command lateral movement and a rotational thrust command to command rotational movement of the vessel. A controller is configured to determine a difference between a steering position of the propulsion device and a centered steering position. A user interface display is controllable to indicate at least one of the steering position of the propulsion device and the difference between the steering position and the centered steering position. The controller is further configured to determine that the steering position is within a threshold range of the centered steering position.

U.S. Pat. No. 11,130,554 discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

U.S. Pat. No. 11,247,753 discloses a method for maintaining a marine vessel at a global position and/or heading that includes receiving measurements related to vessel attitude and estimating water roughness conditions based on the measurements. A difference between the vessel's actual global position and the target global position and/or a difference between the vessel's actual heading and the target heading are determined. The method includes calculating a desired linear velocity based on the position difference and/or a desired rotational velocity based on the heading difference. The vessel's actual linear velocity and/or actual rotational velocity are filtered based on the roughness conditions. The method includes determining a difference between the desired linear velocity and the filtered actual linear velocity and/or a difference between the desired rotational velocity and the filtered actual rotational velocity. The method also includes calculating vessel movements that will minimize the linear velocity difference and/or rotational velocity difference and carrying out the calculated movements.

U.S. Pat. No. 11,358,698 discloses a method for synchronizing shifting of transmissions across marine propulsion devices. The method includes receiving a signal to shift the transmissions and identifying a predetermined shifting time for each of the transmissions, where the predetermined shifting time represents an elapsed time between starting the shifting and completing the shifting. The method further includes comparing the predetermined shifting times to determine a longest shifting time, calculating for each of the transmissions an offset time that is a difference between the corresponding predetermined shifting time and the longest shifting time, and sending a signal to start the shifting of each of the transmissions after waiting the offset time for that transmission such that the transmissions all complete the shifting at the same time.

U.S. Publication No. 2022/0266971 discloses a stowable propulsion system for a marine vessel. A base is configured to be coupled to the marine vessel. A shaft has a proximal end and a distal end with a length axis defined therebetween, where the shaft is pivotably coupled to the base and pivotable about a transverse axis between a stowed position and a deployed position, and where the distal end is closer to the marine vessel when in the stowed position than in the deployed position. A gearset is engaged between the shaft and the base, where the gearset rotates the shaft about the length axis when the shaft is pivoted between the stowed position and the deployed position. A propulsion device is coupled to the distal end of the shaft. The propulsion device is configured to propel the marine vessel in water when the shaft is in the deployed position.

U.S. application Ser. No. 17/869,515 discloses a marine propulsion system for a marine vessel that includes one steerable rear marine drive positioned along the center line of the marine vessel and a lateral marine drive positioned at a bow region of the marine vessel. The rear marine drive is steerable about a vertical steering axis to a range of steering angles. The lateral marine drive is positioned at a fixed angle with respect to the marine vessel and configured to generate lateral thrust on the marine vessel. A user input device is operable by a user to provide a propulsion demand input commanding surge movement, sway movement, and yaw movement of the marine vessel, and the control system is configured to control steering and thrust of the rear marine drive and thrust of the lateral marine drive based on the propulsion demand input to generate the surge movement, sway movement, and/or the yaw movement commanded by the user.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one aspect, a method of controlling a marine propulsion system for a marine vessel is provided, wherein the marine propulsion system includes at least one rear marine drive steerable about a steering axis to a range of steering positions. The method includes receiving a propulsion demand input commanding a surge movement, a sway movement, and/or a yaw movement of the marine vessel. For each of the at least one rear marine drive, a propeller direction and a commanded steering position are determined based on the propulsion demand input, a steering actuator is controlled to steer the rear marine drive toward the commanded steering position, a delayed time to begin propeller engagement is determined to coordinate initiation of propeller rotation with the rear marine drive reaching the commanded steering position. The rear marine drive is then controlled to begin rotating the propeller in the propeller direction based on the delayed time to generate the surge movement, the sway movement, and/or the yaw movement commanded.

In one embodiment, the marine propulsion system further includes a lateral marine drive configured to generate lateral thrust on the marine vessel, wherein the method further comprises determining a lateral thrust command for the lateral marine drive based on the propulsion demand input and controlling the lateral marine drive based on the delayed time to time initiation of the lateral thrust with the initiation of the propeller rotation of the rear marine drive.

In one embodiment, the method further includes predicting a steering end time when the at least one rear marine drive will reach the commanded steering position, and determining the delayed time based on the steering end time.

In another embodiment, the delayed time is determined further based on a shift duration, wherein a shift duration is an amount of time required to engage and begin rotating the propeller and/or a predicted steering end time when the at least one rear marine drive will reach the commanded steering position.

In another embodiment, controlling the rear marine drive to begin rotating the propeller at the delayed time includes commanding shift of a transmission or clutch based on the delayed time, wherein the delayed time is based on a shift duration of the transmission or clutch.

In another embodiment where the marine propulsion system includes at least two rear marine drives, the delayed time for each of the at least two rear marine drives is determined to initiate propeller rotation of all of the at least two rear marine drives at the same time correlated with a last one of the at least two rear marine drives reaching its commanded steering position.

According to one aspect, a method of controlling a marine propulsion system for a marine vessel is provided, wherein the marine propulsion system includes at least one rear marine drive configured to be steerable between a centered steering position and each of a +90 degree position and a −90 degree position. The method includes receiving a propulsion demand input commanding a surge movement, a sway movement, and/or a yaw movement of the marine vessel. Upon receiving a lateral thrust command, a commanded steering position is determined as a closest one of the +90 degree position and the −90 degree position to a start position of the at least one rear marine drive. A propeller direction is then determined based on the commanded steering position. A steering actuator is controlled to steer the rear marine drive toward the commanded steering position, and the drive is controlled to rotate the propeller in the propeller direction to generate the surge movement, the sway movement, and/or the yaw movement commanded.

In one embodiment, the method further includes determining a delayed time to begin propeller engagement is determined to coordinate initiation of propeller rotation with the rear marine drive reaching the commanded steering position. The rear marine drive is then controlled to begin rotating the propeller in the propeller direction while the marine drive is being steered to the commanded steering position and based on the delayed time to generate the surge movement, the sway movement, and/or the yaw movement commanded.

In one aspect, a marine propulsion system for a marine vessel includes at least one rear marine drive configured to generate forward and reverse thrusts, wherein the rear marine drive is steerable about a steering axis to a range of steering positions, and a control system. The control system is configured to receive a propulsion demand input commanding a surge movement, a sway movement, and/or a yaw movement of the marine vessel and, for each of the at least one rear marine drive, determine a propeller direction and a commanded steering position based on the propulsion demand input. A delayed time to begin rotating the propeller is determined to coordinate initiation of propeller rotation with the rear marine drive reaching the commanded steering position. While a steering actuator is controlled to steer the rear marine drive toward the commanded steering position, the rear marine drive is controlled to begin rotating the propeller in the propeller direction at the delayed time to generate the surge movement, the sway movement, and/or the yaw movement commanded.

In one embodiment, the control system is further configured to predict a steering end time when the at least one rear marine drive will reach the commanded steering position and determine the delayed time based on the steering end time.

In one embodiment, the delayed time is determined based on a shift duration, wherein a shift duration is an amount of time required to engage and begin rotating the propeller.

In a further embodiment, controlling the rear marine drive to begin rotating the propeller at the delayed time includes commanding shift of a transmission or clutch based on the delayed time, wherein the delayed time is based on a shift duration of the transmission or clutch.

In one embodiment, controlling the rear marine drive to begin rotating the propeller at the delayed time includes commanding shift of a transmission or clutch based on the delayed time, wherein the delayed time is based on a shift duration of the transmission or clutch.

In one embodiment, wherein the at least one rear marine drive is configured to be steerable between a centered steering position and each of a +90 degree position and/or −90 degree position, and wherein the control system is further configured to, upon receiving a lateral thrust command, determine the commanded steering position as a closest one of the +90 degree position and the −90 degree position to a start position of the at least one rear marine drive and determining the propeller direction based on the commanded steering position.

According to one aspect, a marine propulsion system for a marine vessel includes a rear marine drive configured to generate forward and reverse thrusts, wherein the rear marine drive is steerable about a steering axis to a range of steering positions between a centered steering position and a +90 degree position and/or a −90 degree position, and a lateral marine drive is positioned at a bow region of the marine vessel and at a fixed angle with respect to the marine vessel, wherein the lateral marine drive is configured to generate lateral thrust on the marine vessel. The system further includes a user input device operable by a user to provide a propulsion demand input commanding surge movement, sway movement, and yaw movement of the marine vessel and a control system. The control system is configured to determine a propeller direction and a commanded steering position for the rear marine drive based on the propulsion demand input, and a lateral thrust command for the lateral marine drive based on the propulsion demand input, and then control a steering actuator to steer the rear marine drive to the commanded steering position. A delayed time to begin propeller engagement is then determined to coordinate initiation of propeller rotation with the rear marine drive reaching the commanded steering position. The rear marine drive and the lateral marine drive are then controlled based on the delayed time to generate the surge movement, the sway movement, and/or the yaw movement commanded.

In one embodiment, the rear marine drive is configured to be steerable between the centered steering position and each of the +90 degree position and the −90 degree position, and wherein the control system is further configured to, upon receiving a lateral thrust command, determine the commanded steering position as a closest one of the +90 degree position and the −90 degree position to a start position of the rear marine drive and determining the propeller direction based on the commanded steering position.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1A:
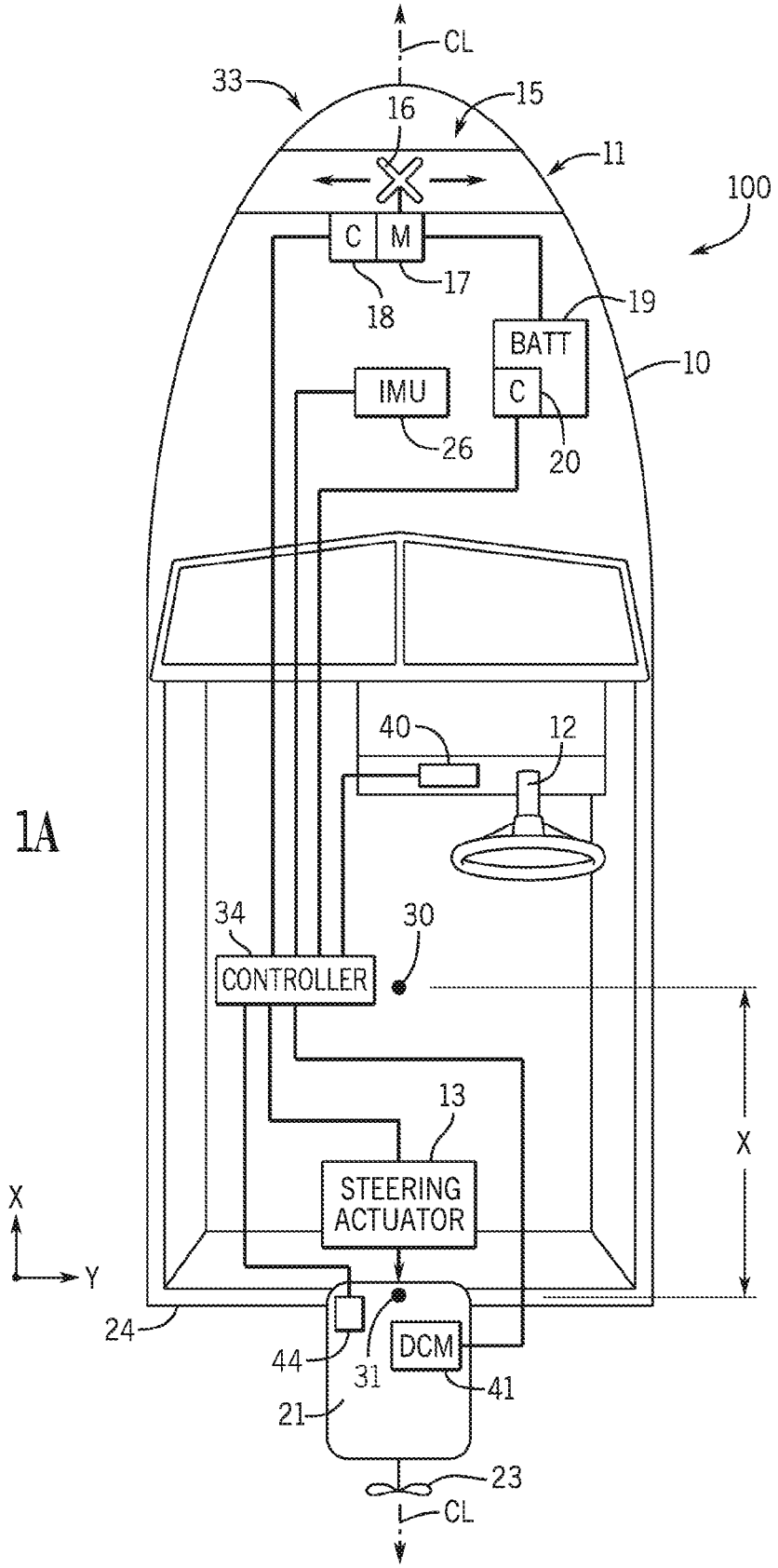
FIG. 1A is a schematic depiction of one embodiment of a marine propulsion system on a marine vessel according to the present disclosure.

The inventors have recognized a need for vessel control systems and methods that provide improved control over lateral and rotational movement of the marine vessel and enable a full range of vessel movement, such as via joystick control. In particular, the inventors have endeavored to develop a marine propulsion system implementing marine drives that are steerable to a wide range of steering positions, such as to angles greater than 45 degrees from a centered (straight ahead) steering position in at least one steering direction (i.e., clockwise rotation or counterclockwise rotation). In some embodiments, one or more of the marine drives may be steerable to enable rotation of the propeller to 90 degrees or more of steering in at least one direction from a centered steering position. The inventors have recognized that propulsion systems utilizing marine drives with broad steering authority, such as steerable to 90 degrees from a centered steering position, have significant advantages in enabling lateral and rotational vessel control utilizing fewer drives (such as with a single rear propulsion device and a bow thruster) and/or utilizing two or more rear drives more efficiently. Namely, thrust output from each of the drives can be directed in precisely the desired direction such that unwanted thrust vector cancellation due to steering limitations is not necessary. Certain movement directions, such as sideways movement (or sway) and turning in place, are not possible on vessels with only a single rear drive having limited steering range, such as less than 90 degrees from center or close thereto. Moreover, in multi-drive systems, wide steering capability minimizes or eliminates the need for unwanted thrust vector cancellation and thus results in a more efficient system.

In endeavoring to develop a propulsion system with marine drives steerable to a wide steering range of steering positions, the inventors recognized a problem with coordinating shift and steering. For example, marine drives steerable to a wide steering range may include drives where at least a portion of the drive containing the propeller is steerable to at least 45 degrees from a centered steering position (i.e., propelling the vessel straight ahead) in at least one steering direction. In some embodiments, the wide steering range includes steerability in at least one rotational direction to a position of at least 50 degrees, at least 60 degrees, at least 70 degrees, or at least 80 degrees from the centered steering position. In some embodiments, the wide steering range includes steerability to at least 90 degrees in at least one direction from the centered steering position so as to generate a lateral thrust at the stern of the vessel.

Given the increased range of potential steering angles, the time it takes to achieve a commanded steering instruction substantially increased. Where a significant steering change is commanded, such as a change of 45 degrees or more, the time it takes to rotate the drive to the commanded steering position is significantly greater than the time it takes to engage the propeller. Namely, where the time to reach the steering position is greater than the time to engage rotation of the propeller, such as a shift time of a transmission, then the propeller begins rotating before the steering position is reached. Starting propeller rotation before the final steering position is reached causes thrust to be generated and the vessel to be propelled in a direction that is not consistent with the commanded direction. This problem is exacerbated with electric propulsion, where the propeller is engaged almost instantaneously upon receiving the output command, and thus the problem occurs at smaller steering angle changes than with internal combustion engine propulsion.

The disclosed method and system are configured to address the above-described problems with coordinating thrust generation and steering by determining a delayed time to begin propeller engagement. The marine drive is then controlled to begin rotating the propeller in a commanded propeller direction based on the delayed time so as to generate only the desired vessel movement and avoid asynchronistic thrust outputs that occur before the steering adjustment has completed. The delayed time is calculated to coordinate initiation of propeller rotation with the marine drive reaching the commanded steering position, such as based on a predicted steering end time. For example, the steering end time may be predicted based on the magnitude of the steering instruction—i.e., the amount that the marine drive needs to be turned to reach the commanded steering position—and a known steering rate, or rate of turn, of the marine drive about the steering axis. For example, the known steering rate may be based on the capabilities and configuration of the steering actuator. Alternatively or additionally, the steering end time may be predicted based on steering position measurements as the drive is moved toward the commanded steering position—e.g., the measured rate of rotation and the remaining amount that the drive needs to be turned to reach the commanded steering position. Alternatively or additionally, the delayed time may be determined based on real-time measurements of steering position by a steering position sensor as the marine drive is moved to the commanded steering position.

The delayed time for engagement of the propeller is then determined based on the steering end time such that rotation commences at or substantially near the time that the marine drive reaches the commanded steering position and such that output thrust is not produced by the marine drive until the commanded steering position is reached. This may be based on the shift duration, which as used herein refers to the amount of time required to engage the propeller shaft and/or begin rotating the propeller. Where the marine drive includes a transmission that needs to be shifted from a neutral state into a forward or reverse gear position to engage the propeller shaft, the shift duration includes the amount of time it takes to shift the transmission into the commanded forward or reverse gear. Where no transmission is included, the shift duration may be based on the amount of time needed to start the propeller rotation (e.g., to start rotating the electric motor powerhead). In such an embodiment, the shift duration may be a very small amount of time and thus may be just before or at the steering end time.

Alternatively, the control system may access a calibrated value enabling determination of a threshold steering angle between a start position and a commanded steering position where the propeller engagement actions (such as shifting the transmission and/or energizing the electric motor) should commence. For example, the calibrated value may be an amount of steering angle change that is time-equivalent to the shift duration or other applicable propeller engagement action such that the propeller engagement action will complete and the propeller will begin rotating at the same time that the steering change completes. Namely, the delayed time is determined as a steering position that is a calibrated threshold steering angle from the commanded steering position and serves as a start trigger for the propeller engagement action(s) such that the propeller engagement action(s) commence once the marine drive reaches the trigger steering position.

The inventors further recognized a need, in multi-drive systems, to coordinate thrust output from multiple drives to effectuate the commanded thrust. The control system and method may be configured to operate a lateral marine drive, one or more rear marine drive(s), or both simultaneously to effectuate a propulsion demand input. When multiple drives are operated to effectuate a desired/commanded vessel movement including either a lateral marine drive and one or more rear marine drives or including a plurality of rear marine drives—the timing of their thrust production may be coordinated such that all drives are operated based on the longest, or latest, delayed time for engaging propeller rotation. Where, for example, one drive takes longer to reach the commanded steering position, the start times of the drives may be coordinated so that the steered drive does not begin producing thrust after the others (which could cause the vessel to initiate movement in the wrong direction). Thus, the propulsion system may be configured to determine the delayed time for each of the multiple marine drives such that all of the drives output the commanded thrust substantially simultaneously.

In endeavoring to develop a propulsion system with marine drives steerable to a wide steering range of steering positions, the inventors further recognized an opportunity for reducing steering time for turns to 90 degrees. In some embodiments, the control system is configured to, upon receiving a lateral thrust command to move a marine drive to a 90 degree steering position, determine the commanded steering position as a closest one of the +90 degree position and the −90 degree position to the start position of the drive. Thereby, the amount of time to reach the commanded steering position is minimized. Since the drive is configured to rotate the propeller in either of the forward or reverse directions, both lateral direction thrusts can be effectuated for either steering position and thus the propeller direction is determined based on which steering position is selected and the commanded lateral thrust direction.

Figure 1B:
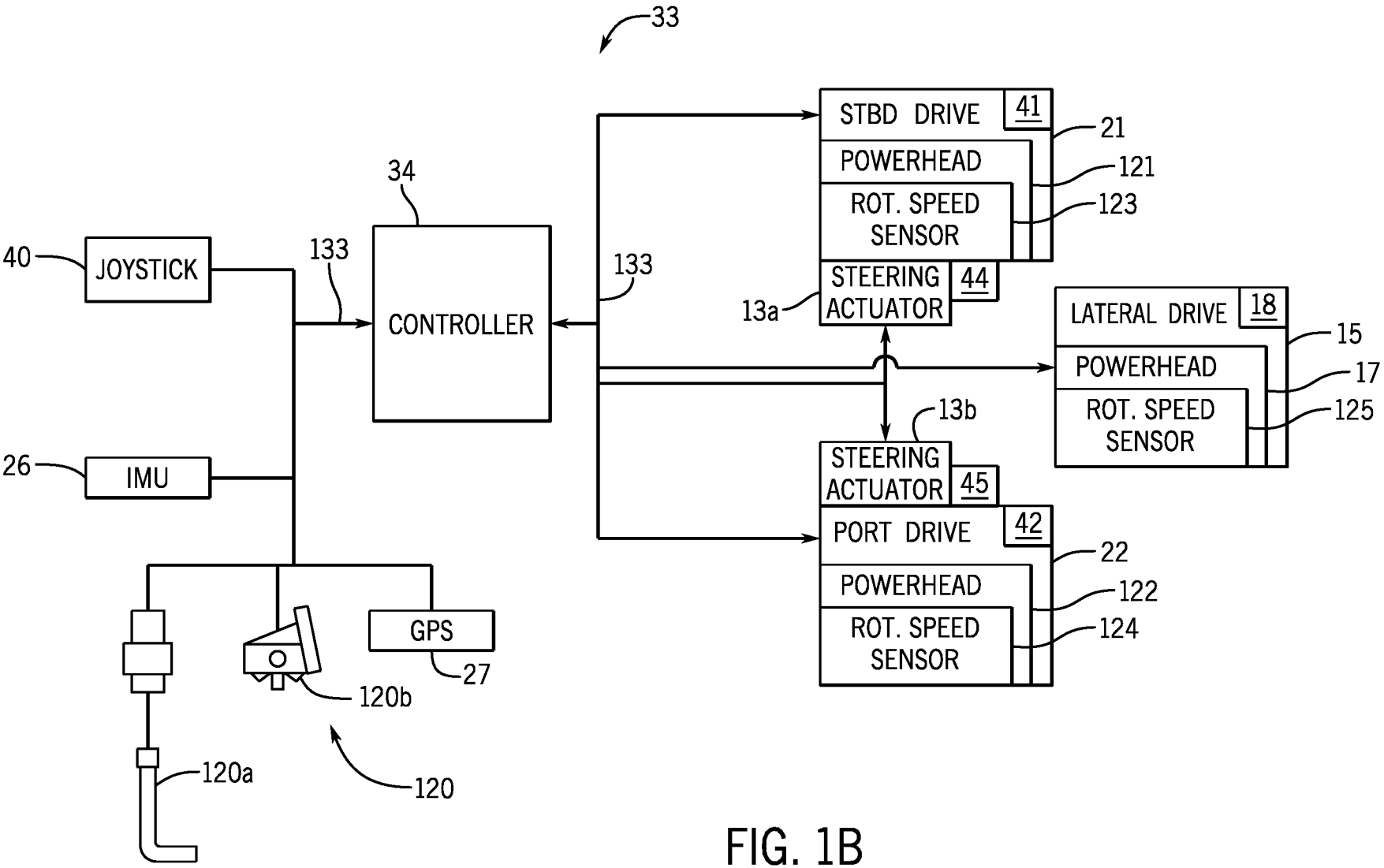
FIG. 1B is a schematic illustration of another embodiment of a marine propulsion system for a marine vessel according to the present disclosure.

FIGS. 1A and 1B are schematic representations of a marine vessel 10 equipped with propulsion system 100. The embodiment shown in FIG. 1A includes one rear marine drive 21 positioned at the stern 24, such as attached to the transom. The single rear marine drive 21 may be mounted along a centerline CL of vessel 10. The single rear marine drive 21 may be, for example, an outboard drive, a stern drive, an inboard drive, a jet drive, or any other type of steerable drive. The rear marine drive 21 is steerable, having a steering actuator 13 configured to rotate the drive 21 about its vertical steering axis 31. The steering axis 31 is positioned at a distance X from the center of turn (COT) 30, which could also be the effective center of gravity (COG). The marine vessel 10 is maneuvered by causing the rear marine drive to rotate about its steering axis 31. The rear marine drive 21 is rotated in response to an operator's manipulation of the steering wheel 12 or joystick 40, which is communicatively connected to the steering actuator 13 to rotate the marine drive 21. Rotating the rear marine drive 21 and effectuating thrust thereby cause rotation of the marine vessel 10 about the effective COT 30.

Also referencing FIG. 1B is a schematic representation of a propulsion system 100 is shown including two rear marine drives 21 and 22 configured to be positioned at the stern 24, such as attached to the transom. Each rear marine drive 21, 22, whether in a single drive arrangement or in an arrangement of two or more rear drives, includes a powerhead 121, 122 configured to rotate a propeller 23 in each of a forward rotational direction to effectuate a forward thrust on the vessel 10 tending to move it in the forward direction and a reverse rotational direction to effectuate a reverse thrust on the vessel 10 tending to move it backward. The powerhead 121, 122 may comprise, for example, an electric motor, an internal combustion engine, or a hybrid arrangement of an electric motor or motor/generator and an internal combustion engine. The number of marine drives is exemplary and a person having ordinary skill in the art will understand in light of the present disclosure that any number of one or more marine drives may be utilized in the disclosed system and method.

Each rear marine drive 21, 22 is individually and separately steerable, each having a respective steering actuator 13*a*, 13*b* configured to rotate the drive 21, 22 about its respective steering axis according, as is standard. The steering axes 31 and 32 are separated by a dimension along the Y axis and at a distance X from the center of turn 30 (COT), which could also be the effective center of gravity (COG). The marine vessel 10 is maneuvered by causing the first and second marine drives to rotate about their respective steering axis. The rear marine drives 21 and 22 are rotated in response to an operator's manipulation of the joystick 40, which is communicatively connected to the steering actuators 13*a*, 13*b*, which rotate the marine drives 21 and 22. Rotating the rear marine drives 21 and 22 and effectuating thrusts thereby cause turn of the marine vessel 10, which in a low-speed docking control mode may include turn about the effective COT 30.

Each rear marine drive 21, 22 is steerable to a wide range of steering angles, such as greater than 45 degrees from a centered steering position in at least one steering direction (i.e., clockwise rotation or counterclockwise rotation). In some embodiments, one or more of the marine drives may be steerable to enable rotation of the propeller to 90 degrees or more of steering in at least one direction from a centered steering position. For example, one or more of the marine drives(s) 21, 22 may be configured with a steerable lower gearcase that enables a wide steering angle range in both directions, such as a full +/−90 degrees of steering such that at least a portion of the drive having the propeller can be turned sideways in each direction. In some embodiments, the marine drive(s) 21, 22 may be steerable through a full 360 degree steering range. In other embodiments, one or more the rear drive 21, 22 may be steerable to 90 degrees in one direction and a lesser steering position in the other direction, such as to 30 degrees or 45 degrees. Where two drives are provided, each may be steerable to 90 degrees in opposite directions toward the outside of the vessel so that collision between the drives is not an issue—e.g., the starboardside drive may be rotatable to 90 degrees in the starboard direction and the portside drive may be rotatable to 90 degrees in the port direction. When steered to 90 degrees in the one direction, the rear drive 21,22 may be operable in forward or reverse rotational direction so as to selectably effectuate thrusts on the marine vessel in both lateral directions.

In both depicted embodiments, propulsion system 100 further includes a lateral marine drive 15 configured to effectuate lateral thrust on the vessel 10 in the starboard and port directions. The lateral marine drive is fixed, not steerable, such that it produces port-direction or starboard-direction lateral thrusts at fixed angles with respect to the marine vessel, such as perpendicular to the centerline CL. In the depicted example, the lateral marine drive 15 is an electric drive positioned at a bow region 11 of the vessel 10 configured to effectuate lateral thrust at the bow, which may also be referred to as a bow thruster. The bow region 11 is near the bow of the vessel so as to be in front (toward the bow) of the COT 30. Bow thrusters are known to those skilled in the art, as are other types and locations of marine drive arrangements configured to effectuate lateral thrusts on the vessel 10, and likewise the lateral marine drive 15 may be placed at other locations on the vessel 10 besides the bow region 11 and/or two or more lateral marine drives 15 may be included and located at different locations. The lateral marine drive 15 may be a discrete drive, or discrete thruster, that operates only at a predetermined RPM and thus is only controllable by turning on and off the drive. Alternatively, the lateral marine drive 15 may be a proportional drive, or proportional thruster, wherein the rotational speed (e.g., rotations per minute RPM) is controllable by the control system 33 between a minimum RPM and a maximum RPM that the drive is capable or rated to provide. A person having ordinary skill in the art will understand in view of the present disclosure that the disclosed propulsion system 100 may include other types and locations of lateral marine drives 15, which may be an alternative to or in addition to a lateral drive 15 positioned at the bow region 11.

The lateral marine drive 15 may also be deployable for use and retractable when not in use, such as deployable for docking and stowed for on plane boating. Exemplary deployable lateral marine drives are described in U.S. Application Nos. 2022/0266971, 2022/0266972, and Ser. No. 17/553,245, which are hereby incorporated by reference in their entireties. In embodiments where the lateral marine drive 15 is deployable and retractable in response to a user input, such as a user input to engage a docking or other joysticking mode where the lateral drive 15 is utilized. The lateral marine drive 15 may be a discrete drive, or discrete thruster, that operates only at a predetermined RPM and thus is only controllable by turning on and off the drive. Alternatively, the lateral marine drive 15 may be a proportional drive, or proportional thruster, wherein the rotational speed (e.g., rotations per minute RPM) is controllable by the control system 33 between a minimum RPM and a maximum RPM that the drive is capable or rated to provide.

The lateral marine drive 15 may include a propeller 16, sometimes referred to as a fan, that is rotated by a bi-directional motor 17 in forward or reverse direction to effectuate lateral thrust in the starboard or port directions. In such an embodiment, the lateral marine drive 15 is configured to rotate in a first direction to generate a starboard direction lateral thrust and to rotate in an opposite direction of the first direction to generate a port direction lateral thrust. The controller 34 may be communicatively connected to a drive controller 18 for the lateral marine drive 15 to control activation and direction of thrust by the lateral marine drive 15. Where the lateral drive 15 is configured as a discrete drive, the controller 18 provides on/off and directional control of the motor 17, and thus rotate in the clockwise and counterclockwise directions at a single speed. The controller 34 may be configured to modulate the duty cycle of the discrete lateral drive to achieve desired thrust outputs. In other embodiments, the lateral marine drive 15 is a variable speed drive, wherein the motor 17 is controllable to rotate the propeller 16 at two or more speeds. For example, the motor 17 may be a brushless DC motor configured for variable multi-speed control of the propeller 16 in both the clockwise and counterclockwise rotation directions to effectuate a range of lateral thrust outputs.

Where one or more of the marine drives 15, 21 is an electric drive i.e., having a powerhead being an electric motor—the propulsion system 100 will include a power storage device 19 powering the motor(s) thereof. The power storage device 19, such as a battery (e.g., lithium-ion battery) or bank of batteries, stores energy for powering the electric motor(s) (e.g., motor 17) and is rechargeable, such as by connection to shore power when the electric motor is not in use or by an on-board alternator system drawing energy from engine-driven marine drives (if any) on the marine vessel. The power storage device 19 may include a battery controller 20 configured to monitor and/or control aspects of the power storage device 19. For example, the battery controller 20 may receive inputs from one or more sensors within the power storage device 19, such as a temperature sensor configured to sense a temperature within a housing of the power storage device where one or more batteries or other storage elements are located. The battery controller 20 may further be configured to receive information from current, voltage, and/or other sensors within the power storage device 19, such as to receive information about the voltage, current, and temperature of each battery cell within the power storage device 19. In addition to the temperature of the power storage device, the battery controller 20 may be configured to determine and communicate a charge level to the central controller 34 and/or another controller within the control system 33. The charge level may include one or more of, for example, a voltage level of the power storage device, a state of charge of the power storage device 19, a state of health of the power storage device 19, etc.

Figure 2A:
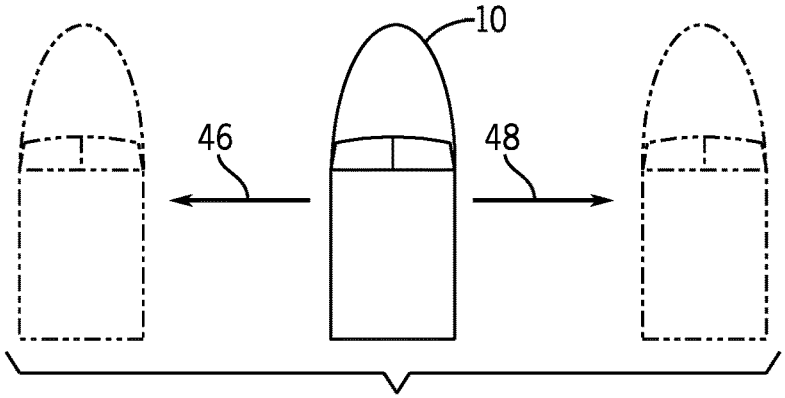
FIGS. 2A-2E are schematic illustrations of various movements of a marine vessel.
Figure 2B:
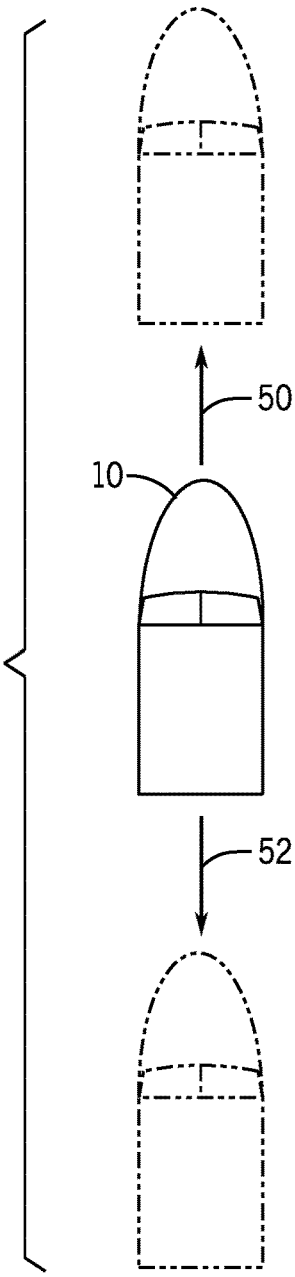
Figure 2C:
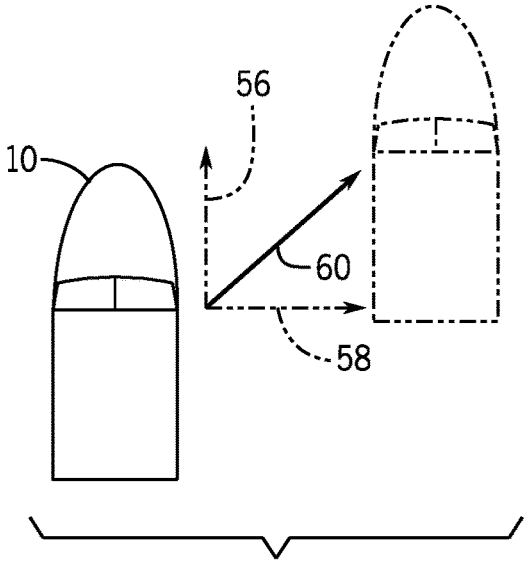
Figure 2D:
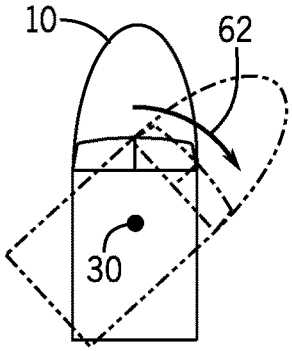
Figure 2E:
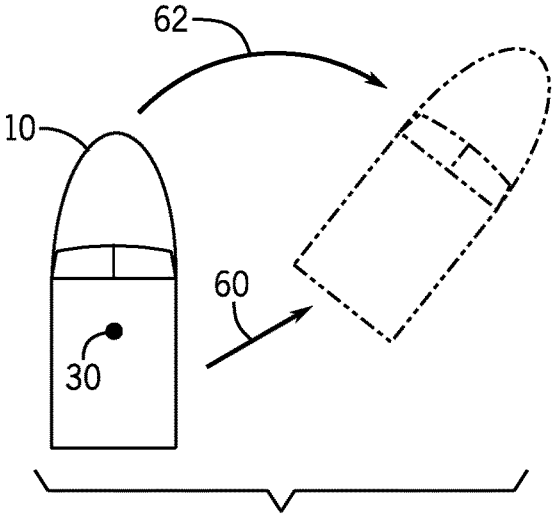

The propulsion system 100 further includes a user input device 40, such as a joystick or a keypad, operable by a user to provide at least a lateral movement demand input and rotational movement demand input. The user input device enables a user to give a lateral propulsion demand commanding sway movement of the marine vessel, or longitudinal movement along the y-axis, without requiring surge movement along the x-axis. The user input device also enables a user to give a rotational propulsion demand input commanding rotational movement of the marine vessel 10 about the COT 30 without lateral or surge movements. FIGS. 2A-2E illustrate exemplary vessel movements that may be commanded via the user input device 40. FIG. 2A shows the vessel 10 moving laterally, or sway movement, in the port direction 46 and the starboard direction 48 without any forward or reverse motion and without any rotation about its COT 30. FIG. 2B shows the vessel 10 moving in the forward 50 direction and backward 52 direction, also known as surge movement. FIG. 2C shows a combination of forward surge and starboard sway motions of the vessel 10, where the surge movement is represented by the dashed arrow 56 and the sway movement is represented by the dashed arrow 58. The resultant motion vector 60 moves the vessel in the forward and starboard directions without any rotation. FIG. 2D illustrates a clockwise rotation 62, or yaw movement, of the marine vessel 10 about the COT 30 without any translation movement, including any surge movement or sway movement. FIG. 2E illustrates a combination of yaw movement, represented by arrow 62, and surge and sway translation in the forward and starboard directions, represented by arrow 60.

The disclosed system and method enable lateral and rotational movement of the marine vessel, such as that illustrated in FIGS. 2A-2E, by effectuating steering and thrust control of the rear marine drive(s) 21,22 and thrust control of the lateral marine drive 15. If the drive angle of the marine drives 15 and 21, 22 is known, then vector analysis can be performed to effectuate any rotational movement. In an embodiment incorporating a lateral marine drive 15, lateral movement in the port direction 46 and the starboard direction 48 can be optimized. Additionally, forward direction 50 and reverse direction 52 movement can be improved and more precisely effectuated by using the lateral drive to correct for any undesired sway or rotation. The system 100 is configured to provide translational movement in other translational directions combining forward/reverse and port/starboard thrusts of the rear and lateral drives 21,22 and 15.

The user steering inputs provided at the user input device 40 are received by the control system 33, which may include multiple control devices communicatively connected via a communication link, such as a CAN bus (e.g., a CAN Kingdom Network), to control the propulsion system 100 as described herein. In the embodiment of FIG. 1, the control system 33 includes a central controller 34 communicatively connected to the drive control module (DCM) 41, 42 of each the rear marine drive 21,22 the DCM 18 of the lateral marine drive 15, and may also include other control devices such as the battery controller 20. Thereby, the controller 34 can communicate instructions to the DCM 41, 42 of each rear drive 21, 22 to effectuate a commanded magnitude of thrust and a commanded direction of thrust (forward or reverse), as is necessary to effectuate the lateral and/or rotational steering inputs commanded at the user input device 40. The controller also communicates a steering position command to the steering actuator(s) 13*a*, 13*b* to steer the marine drive(s) 21,22. A drive position sensor 44, 45 is configured to sense the steering angle, or steering position, of each drive 21, 22. The central controller 34 also communicates a command instruction to the DCM 18 for the lateral marine drive, wherein the commands to the various drives 15, 21, 22 are coordinated such that the total of the thrusts from the rear and lateral marine drives yields the user's propulsion demand input. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Figure 3:
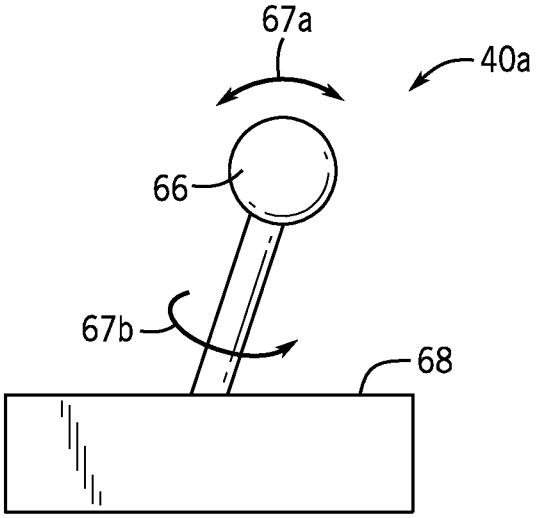
FIG. 3 illustrates an exemplary joystick user input device.
Figure 4:
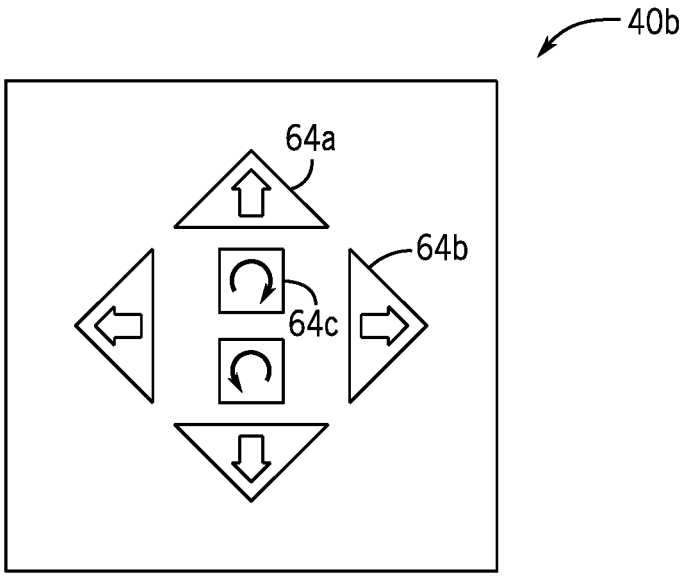
FIG. 4 illustrates an exemplary keypad user input device.

FIGS. 3 and 4 exemplify two possible types of user input devices 40. FIG. 3 depicts a well-known joystick device that comprises a base 68 and a moveable handle 66 suitable for movement by an operator. Typically, the handle can be moved left and right (represented by arrow 67*a*), forward and back, as well as twisted (represented by arrow 67*b*) relative to the base 68 to provide corresponding movement commands for the propulsion system. FIG. 4 depicts an alternative user input device 40*b* being a keypad with buttons 64 associated with each of the right, left, forward, backward, and rotational movement directions. Thus, a forward button 64*a* can be pressed by a user to provide a forward thrust command to move the marine vessel forward and key 64*b* can be pressed by a user to input a lateral thrust command to command lateral movement of the marine vessel 10. Similarly, the clockwise rotation key 64*c* can be pressed by a user to input a clockwise rotational thrust command to command clockwise rotational movement of the marine vessel 10. The other keys on the keypad 40*b* operate similarly. The joystick 40*a* and keypad 40*b* are merely exemplary, and other types of user input devices enabling a user to command lateral and rotational movement are within the scope of the present disclosure.

In certain embodiments, the user input device 40 may be operable in multiple modes selectable by a user. For example, the user input device 40 may be operable in a first mode to control only the lateral marine drive 15. The user input device 40 may also be operable in a second mode to control both the lateral marine drive 15 and the rear marine drive 21 in conjunction, such as according to one or more of the embodiments described herein. Alternatively or additionally, the user input device 40 may be operable in a mode to enable separate control of both the lateral marine drive 15 and the one or more rear marine drive 21, 22 such as where the lateral marine drive 15 is controlled by certain movements of the joystick 40*a* and the rear drive(s) 21, 22 is controlled by other movements of the joystick 40*a*. To provide one example for illustration, the system may be configured such that twist movement of the joystick 40*a* controls the lateral thrust produced by the lateral marine drive 15 and sideways deflection of the joystick 40*a* controls steering and/or propulsion magnitude of the rear marine drive(s) 21, 22. Conversely, the system may be configured such that twist movement of the joystick 40*a* controls thrust and/or steering of the rear marine drive(s) 21, 22 and sideways deflection of the joystick 40*a* controls the lateral thrust produced by the lateral marine drive 15. Thereby, the user can select which drive to control by selectively controlling the joystick, and can control both simultaneously, such as by manipulating the joystick with a sideways deflection and a twist movement.

The propulsion system 100 may be configured such that the user can select an operation mode for the user input device 40, for example via buttons or other user interface elements on the joystick or elsewhere at the helm. Alternatively or additionally, the system 100 may be configured to automatically select one or more of the operation modes based on engagement of various user input devices.

Where the user input device 40 is configured to operate in multiple modes, the control system 33 may be configured to selectively employ the methods and systems described herein only when operating in certain modes. For example, engagement of a "joysticking mode" or a "docking mode", such as via a respective selection button on the user interface 40 or a touch screen at the helm, may enable steerability and operation of the one or more drives 21, 22 to a maximum steering angle (e.g., to enable steering the drive to 90 degrees from the centered position. Alternatively, such user selection may be provided by selective engagement and disengagement of various user input elements at the helm. For example, the second mode may be selectable by engaging the user interface 40, such as the joystick or touchpad, and disengaging all other helm thrust control elements for the marine drives, such as putting all throttle/shift levers in neutral or otherwise deactivating the steering and/or thrust control functions.

The disclosed propulsion system 100 enables joystick control, or control by another user input device operable to provide lateral and rotational thrust control, of both the rear and lateral marine drives simultaneously. Optionally, such as based on a mode selection, the drives may be controlled automatically based on a single user input commanding a thrust magnitude and direction such that the drives operate to provide precise and seamless sway and yaw control of the vessel 10. Alternatively, the user input device may enable a user to input simultaneous control instructions for each of the lateral and rear drives 15 and 21, 22. Additionally, the permitted range of steering angles may be defined based on mode selection. For example, rotation of the drive(s) to a 90 degree steering angle (or other maximum steering position) may only be available when certain mode(s) are engaged, such as when joysticking mode and/or docking mode are engaged.

FIGS. 5A-5E exemplify integrated control of a fixed lateral drive and one steerable rear marine drive, illustrating force coupling between a rear marine drive 21 and the lateral marine drive 15 to effectuate commanded yaw movement of the vessel. While the examples illustrate control of a propulsion system comprising one centered rear marine drive 21, a person of ordinary skill in the art will understand in view of the present disclosure that the force coupling would be adaptable to effectuate the same vessel movements with two or more rear marine drives 21 and 22. The capabilities of the propulsion system 100 to effectuate yaw and sway movement of the marine vessel 10 using only a single rear marine drive 21 will depend on steering maneuverability of the rear marine drive 21, whereas pure sway and pure yaw movements are achievable with propulsion systems comprising at least two rear marine drives 21, 22. If the range of steering angles closely approaches or reaches 90 degrees in each direction from a centered steering position, then the marine vessel can maximally effectuate yaw movement without incidentally generating significant surge as well. This range of steering control is not possible with many drive types, but some drive arrangements do enable rotation of the propulsor to 90 degrees or more of steering in at least one direction. In single rear drive systems where a lesser steering angle range is available, some incidental surge thrust may be generated, as explained more below. To effectuate yaw movement to turn the vessel about its COT 30 without causing surge or sway movements, the control system 33 may utilize the rear marine drive 21 generating forward or reverse thrust to push the stern in the desired direction and may utilize the lateral drive 15 to push the bow in the opposite direction to generate the total commanded yaw thrust. Alternatively, yaw may be effectuated (perhaps with some minimal surge and/or sway) using only the rear drive 21 or only the lateral drive 15. Exemplary scenarios are illustrated and described in more detail below.

The controller 34 may be configured to utilize yaw rate, such as from an inertial measurement unit (IMU) 26 or other rotational sensor capable of measuring yaw of the marine vessel 10, as the basis for controlling thrust magnitude and direction from one or both drives 15 and 21. The sensed yaw rate can be used as feedback control for adjusting the thrust commands. Namely, the controller 34 may determine an expected yaw rate, or yaw velocity, associated with the lateral and/or rotational thrust command from the user input device 40 and may compare the measured yaw rate and/or rate of lateral movement from the IMU 26 to the expected value(s) and adjust the thrust and/or steering commands to reduce the difference between the measured and expected values, such as between the measured yaw rate and the expected yaw rate.

Figure 5A:
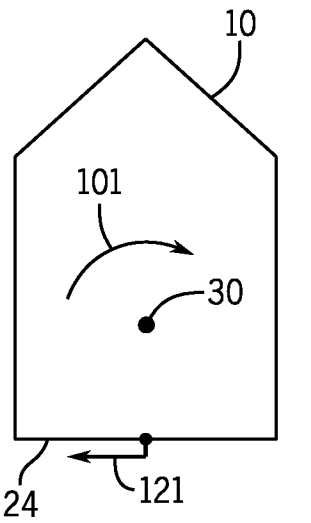
FIGS. 5A-5E depict combinations of thrust vectors by the exemplary propulsion system of FIG. 1 to effectuate exemplary yaw movements of the vessel.

FIG. 5A illustrates an example where yaw thrust is effectuated using only the rear marine drive 21 in an arrangement where the rear marine drive is steerable to +/−90 degrees from center. The marine drive 21 is steered to a maximum steering angle, which here means that the thrusts effectuated are parallel to the stern 24 or transom. The rear marine drive 21 is controlled to effectuate a forward rotation, represented by vector 121. This results in a yaw thrust in the clockwise direction about the center of turn 30, shown by arrow 101. Some sway thrust will also be generated (not shown). The magnitude of the yaw thrust versus the sway will depend on the magnitude of the moment arm of the thrust 121, which depends on the distance X between the marine drive and the COT 30 (see FIG. 1) and will also be influenced by vessel dynamic factors such as the hull shape and water resistance on the hull.

Figure 5B:
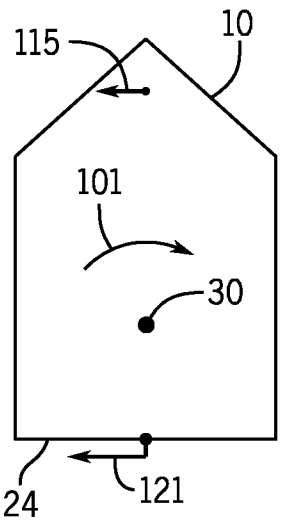

FIG. 5B illustrates the addition of the lateral drive thrust, vector 115, to decrease the total yaw thrust on the marine vessel by counteracting a portion of the yaw thrust from the rear marine drive 21. For example, each of the lateral marine drive and the rear marine drive may have a minimum thrust that it can effectuate, meaning that there is a minimum yaw rate that can be generated by using only the lateral marine drive 15 or only the rear marine drive 21, alone. In certain embodiments, the minimum thrust for the lateral marine drive 15 may be different than that for the rear marine drive 21. For example, the lateral marine drive may be a smaller drive, and thus may have a lower minimum thrust capability. The lateral marine drive may be an electric drive and the rear marine drive 21 may be a combustion-powered drive, and thus the lateral marine drive 15 may have a lower minimum thrust output capability than the rear marine drive 21. By operating the lateral marine drive 15 in opposition to the total yaw thrust from the rear marine drive 21, a lower total yaw thrust 101 and resulting yaw velocity is achievable than is possible with the rear drive 21 alone or the lateral drive 15 alone.

FIG. 5B builds on the example in FIG. 5A, where the rear marine drive 21 is steered to a maximum steering angle of 90 degrees from center and operated generate forward thrust vector, resulting in a clockwise yaw thrust. The yaw thrust generated by the rear drive 21 is partially counteracted by an opposing yaw thrust from the lateral marine drive 15. Specifically, the lateral marine drive 15 is operated to generate a thrust forcing the bow in the port direction and thus effectuating a counterclockwise yaw moment about the center of turn 30. The yaw moment generated by the lateral marine drive thrust vector 115 opposes the yaw thrust generated by the rear marine drive 21, thus decreasing the total yaw thrust. The port-direction lateral thrust 115 will also have a sway component, the magnitude of which will depend on the moment arm between the lateral marine drive 15 and the COT 30, as well as the vessel dynamics. However, the sway component may be negligible when the lateral thruster 15 is operated to generate minimal lateral thrust for a short period, and thus the main effect will be to reduce the rotational movement of the vessel so as to provide fine control over yaw movements.

Figure 5C:
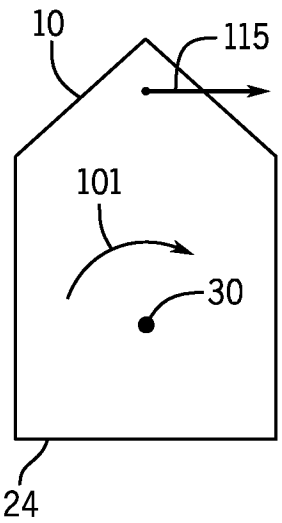

FIG. 5C illustrates an example where yaw motion is generated only utilizing the lateral marine drive 15. As is noted above, the lateral marine drive 15 will also exert a sway thrust component on the vessel 10, and thus operating only the lateral marine drive to generate the yaw motion may also result in effectuating a sway motion. Where the lateral marine drive 15 is operated to effectuate a starboard direction thrust on the bow region 11, a clockwise total yaw thrust 101 about the COT is generated.

Depending on the types and thrust capabilities of the various marine drives 15 and 21 on the vessel 10, it may be preferable to meet a commanded yaw thrust utilizing only the lateral marine drive 15 or only the rear drive 21. For example, where the rear marine drive 21 are configured for high thrust output, it may be preferable to utilize only the lateral marine drive 15 when the propulsion demand input is within a low yaw demand range, which may be at or below the minimum thrust capabilities of the rear marine drive 21 and/or may yield smoother and more comfortable operation for the user by minimizing shifting of the rear marine drive.

Figure 5D:
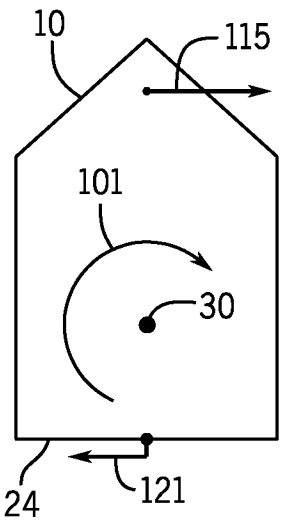

Operating the lateral marine drive in concert with the rear marine drive can yield a greater total yaw velocity when the thrust generated by all of the marine drives are additive. FIG. 5D illustrates one example where the lateral marine drive 15 is operated to generate a thrust that is additive to the yaw thrust generated by the rear marine drive 21. Namely, the yaw component of the starboard direction thrust on the bow, represented by vector 115, adds to the yaw component of the thrust vector 121 to effectuate an even larger yaw force about the COT 30, represented by arrow 101. Thereby, the yaw acceleration is increased and the total possible yaw velocity is also increased beyond that achievable with only the rear marine drive 21 or only the lateral marine drive 15.

Further, operation of both the lateral drive 15 and the rear drive 21 can be coordinated such that the incidental sway components cancel, or at least partially counteract, each other. In the example in FIG. 5D, the sway component of the starboard direction thrust on the bow, represented by vector 115, cancels out at least a portion of the sway component resulting from the rear propulsion device 21.

Figure 5E:
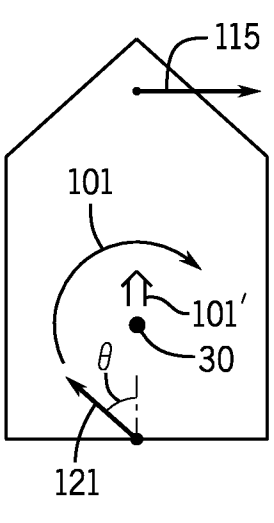

FIG. 5E depicts a similar thrust arrangement ad FIG. 5D, except that the rear marine drive has a more restricted steering range. In the embodiment represented in FIG. 5D, the rear marine drive cannot be steered to +/−90 degrees and is shown steered to its lesser maximum steering position θ, such as +/−60 degrees and generating a forward thrust. In other embodiments, the maximum steering angle θ range may be greater, such as +/−80, or may be smaller, such as +/−45 degrees or +/−30 degrees. Where the rear marine drive 21 is not steerable to 90 degrees, the thrust generated at the maximum steering position θ will have a surge component 101' that is not canceled out by thrust vector 115 from the lateral marine drive 15. The magnitude of the surge component 101' will depend on the maximum steering angle +/−0, as well as the vessel dynamics. Where the maximum steering angle θ range is significantly narrowed from 90 degrees, such as 45 degrees or less, the control system may be configured to favor utilizing the lateral drive 15 to generate only yaw movement (turn in place) when no surge movement is commanded to minimize the incidental and undesired surge movement of the vessel as much as possible.

Figure 6B:
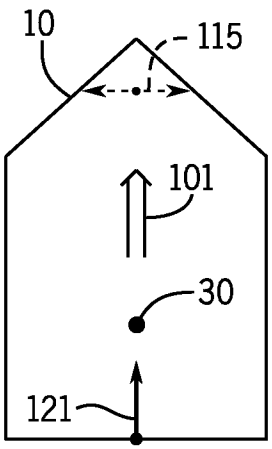
FIGS. 6A-6B depict combinations of thrust vectors by the exemplary propulsion system of FIG. 1 to cancel yaw when effectuating exemplary surge movements of the vessel.
Figure 6A:
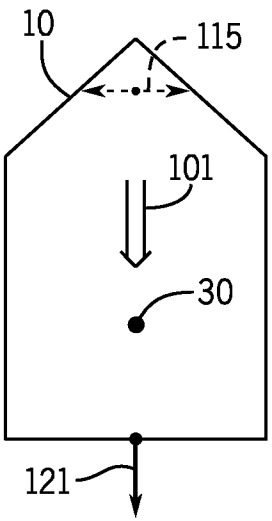

FIGS. 6A and 6B illustrate examples where surge thrust is effectuated with the rear marine drive 21, and the lateral drive 15 is operated to cancel any unwanted yaw such as to enable the marine vessel to travel straight backward or straight forward. The inventors have recognized that straight forward or backward motion is sometimes difficult to achieve with only the rear drive because there are often asymmetrical forces on the starboard and port sides of the hull, such as due to wind, waves, and current. This may be a particular issue when moving the vessel in reverse, where the wide and typically flat stern may amplify the effects of asymmetrical forces on the vessel from water and wind. Thus, the disclosed system is configured to selectively utilize the at least one lateral marine drive 15 to counteract any uncommanded yaw motion that may occur during a surge motion of the vessel 10, such as to enable the marine vessel to travel straight forward and/or straight backward.

In FIG. 6A, the rear marine drive 21 is controlled to effectuate rearward thrust 121, steered to a centered drive angle such that the thrust effectuated is perpendicular to the stern 24, to move the vessel straight backward as indicated by arrow 101. In FIG. 6B, the rear marine drive 21 is controlled to effectuate forward thrust 121, steered to a centered drive angle such that the thrust effectuated is perpendicular to the stern 24, to move the vessel straight forward. In both the rearward and forward motion examples, the lateral marine drive 15 is controlled to counteract any yaw motion of the vessel 10 that might occur, and thus may be actuated in either the forward or reverse rotational directions to effectuate starboard or port lateral thrusts 115 depending on which unwanted yaw rotation is being counteracted.

Thus, the lateral marine drive 15 is likely controlled intermittently during surge motions to effectuate the lateral thrust 115 to counteract any measured yaw change. For example, the direction and magnitude of the lateral thrust 115 may be determined and effectuated by the control system 33 in response to and based on sensed yaw changes, such as based on the direction and magnitude of yaw velocity and/or yaw acceleration of the vessel 10 measured by the IMU 26.

Figure 7B:
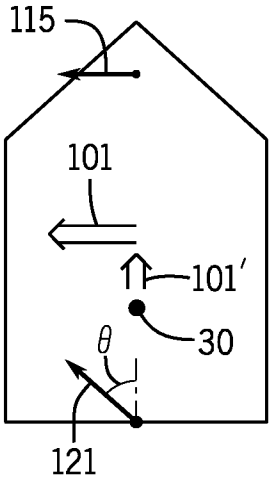
FIGS. 7A-7B depict combinations of thrust vectors by the exemplary propulsion system of FIG. 1 to effectuate exemplary sway movements of the vessel.
Figure 7A:
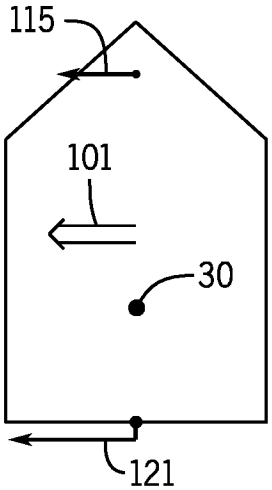

FIGS. 7A-7B exemplify integrated control of lateral and rear marine drives, illustrating force coupling between the rear marine drive 21 and the lateral marine drive 15 to effectuate sway movement of the vessel 10. To effectuate only a sway movement, and thus to move the vessel 10 laterally sideways without causing yaw or surge movements, the control system utilizes both the rear marine drive 21 and the lateral drive 15 to generate additive sway thrusts. When the sway thrusts generated by the rear drive 21 and the lateral drive 15 are in the same direction, the yaw moments are in opposite rotational directions and thus cancel one another.

FIG. 7A depicts an example where the rear marine drive 21 and the lateral marine drive 15 are each operated to generate a sway thrust in the port direction, which add together to effectuate a port side sway motion of the marine vessel 10, represented by arrow 101. The control system may be configured to control the lateral marine drive 15 and the rear marine drive 21 such that the yaw components of the respective thrusts, the yaw moments, are about equal and opposite in magnitude such that they effectively cancel each other out. The yaw component generated by each drive 15, 21 is a product of its distance from the COT 30, as well as vessel dynamics, etc., and the control system may be configured to calculate and balance work between the lateral drive 15 and the rear drive 21 such that no substantial total yaw moment results and straight sway motion is generated. Moreover, the control system may be configured to control the drives based on input from the IMU 26 so as to make adjustments to output of one or both drives 15, 21 to counteract any detected yaw motion.

The example in FIG. 7A assumes that the rear drive 21 is steerable to 90 degrees from center in at least one of the clockwise or counterclockwise directions about the steering axis. This arrangement is ideal for producing sway movement of the marine vessel 10 without producing any surge movement. In FIG. 7B, the rear marine drive cannot be steered to +/−90 degrees and is shown steered to its lesser maximum steering position θ, such as +/−60 degrees. In other embodiments, the maximum steering angle θ range may be greater, such as +/−80, or may be smaller, such as +/−45 degrees or +/−30 degrees. Where the rear marine drive 21 is not steerable to 90 degrees, the thrust generated at the maximum steering position θ will have a surge component 101' that cannot be canceled out by thrust vector 115 from the lateral marine drive 15. The magnitude of the surge component 101' will depend on the maximum steering angle +/−0, as well as the vessel dynamics. Where the maximum steering angle θ range is significantly narrowed from 90 degrees, such as 45 degrees or less, the surge component may be significant and the control system may be configured to favor utilizing the lateral drive 15 to generate sway movement to minimize the undesired surge movement of the vessel as much as possible.

The disclosed system and method are configured to translate propulsion demand inputs into thrust outputs from the appropriate one or more drives in the propulsion system 100.

As disclosed herein, the propulsion demand input may be from a user-operated input device, such as a joystick, keypad, steering wheel and/or throttle levers, etc. Alternatively, the propulsion demand input may be from a navigation controller configured to autonomously or semi-autonomously generate propulsion commands, such as based on input from distance sensors and/or perception systems. In some embodiments, the system is configured such that the user operates the user input device to provide separate commands for each of the rear drive(s) 21, 22 and the lateral marine drive 15. In such embodiments, independent steering and thrust commands (including direction and magnitude) may be calculated sent to the rear marine drive(s) and the lateral marine drive. In other embodiments, the system may be configured to provide integrated user input control, where the user provides a single input motion representing desired motion of the vessel and the control system 33 operates both the lateral and rear drive based on the single user input to effectuate the commanded movement. In such embodiments, the control system 33 is configured to selectively activate the lateral drive 15 and/or rear drive(s) 21, 22 to accomplish the desired vessel motion. Thereby, lateral drive output and rear drive output (including lateral drive thrust direction and magnitude, rear drive steering, and rear drive output/RPM) are blended to provide proportional maneuverability of the vessel in the axis that the joystick handle 66 is deflected.

Figure 9:
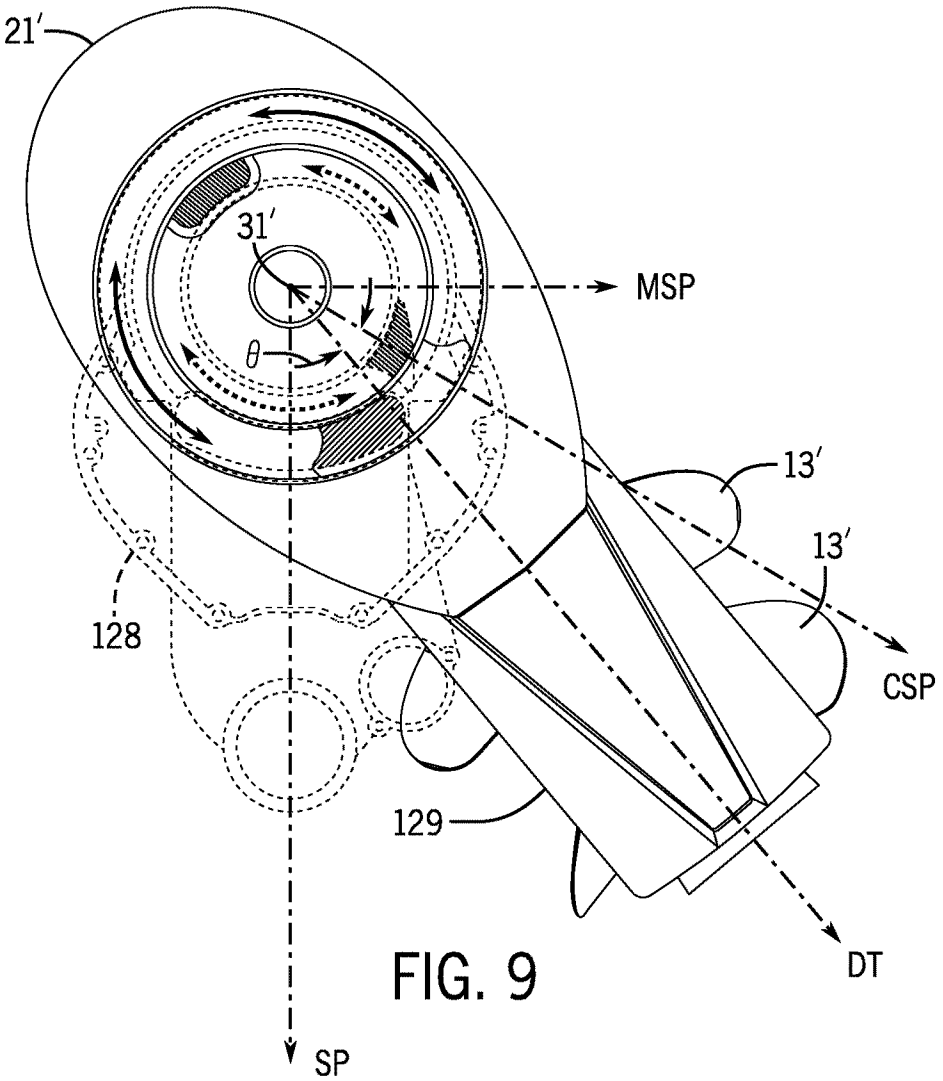
FIGS. 8-9 exemplify a marine drive arrangement having a steerable gearcase that is steerable to a wide range of steering positions and a delayed time to begin propeller engagement based on a commanded steering position in accordance with one embodiment of the present disclosure.
Figure 8:
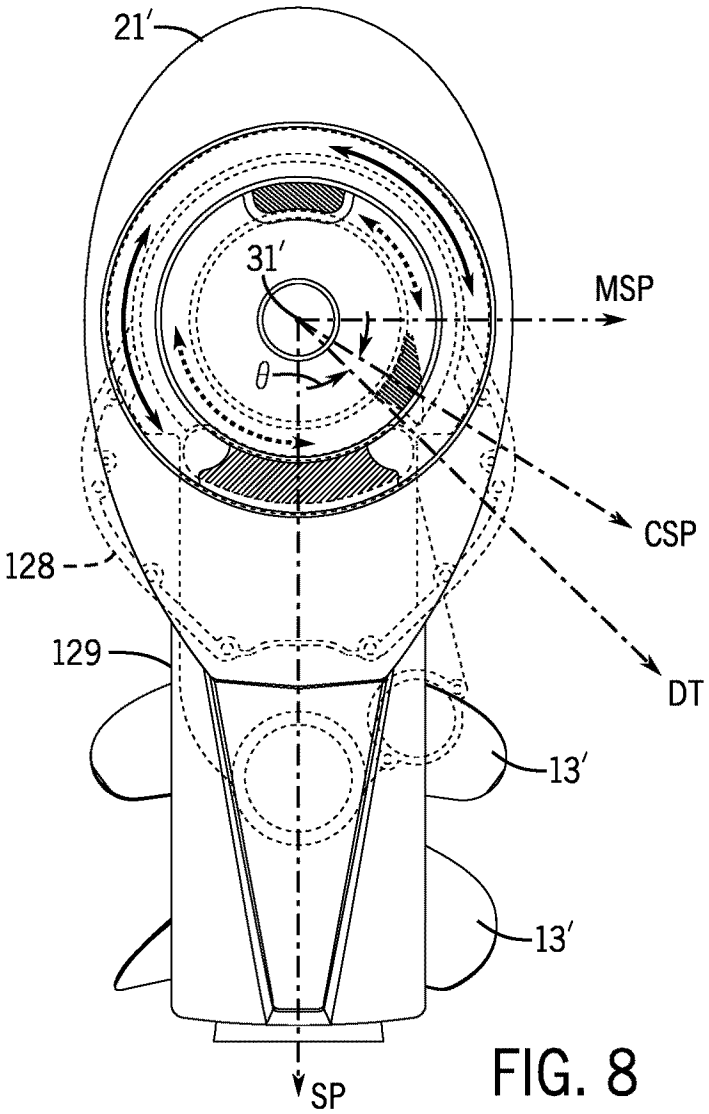

FIGS. 8 and 9 exemplify a marine drive arrangement having a steerable gearcase that is steerable to a wide range of steering positions, which here includes 90 degrees in at least one direction. The figures are a top-down cross sectional view of the marine drive 21', which includes a stationary portion 128 configured to attach to the transom or other portion at the stern of the marine drive 10 and a steerable portion 129 that comprises the propeller(s) 13' and is configured to be rotated about the steering axis 31' by a steering actuator to a wide range of steering positions. Here, the wide range of steering positions includes a maximum steering position MSP of 90 degrees from the centered steering position (shown here as the start position SP). However, the wide range of steering positions may differ and in other embodiments the maximum steering position MSP may be less than or greater than 90 degrees from center, as described in more detail above. FIG. 8 shows the marine drive 21' in a start position, which here is the centered steering position SP. FIG. 9 shows the marine drive 21' in a steering position of about 45 degrees from the centered position toward the maximum steering position MSP.

When a commanded steering position CSP is received, the steering actuator begins rotating the marine drive 21' (i.e., the steerable portion thereof) toward the commanded steering position. Here, the commanded steering position CSP is between the maximum steering position MSP and the start position SP, such as about 60 degrees from the start position SP. A delayed time DT to begin propeller engagement is determined to define the trigger point where/when the propeller engagement action(s) should commence while the marine drive is being steered towards the commanded steering position CSP. The delayed time DT is appropriately timed prior to the marine drive reaching the commanded steering position CSP depending on how long the engagement actions take, such as whether the drive includes a transmission or clutch and whether the powerhead is an internal combustion engine or an electric motor. Here, the delayed time DT is set at about 45 degrees from the start position SP, and thus the propeller engagement actions will be triggered to begin once the marine drive 21' reaches the 45 degree steering angle, which is set as the delayed time DT marker. Various methods for determining the delayed time DT are described herein, which may include determining the delayed time as an angle θ from the commanded steering position CPS or as an amount of time from a predicted steering end time when the marine drive 21' will reach the commanded steering position CSP. The delayed time DT may be based on the shift duration—i.e., an amount of time required to engage and begin rotating the propeller—for the marine drive 21', which is explained in more detail elsewhere herein.

Figure 10:
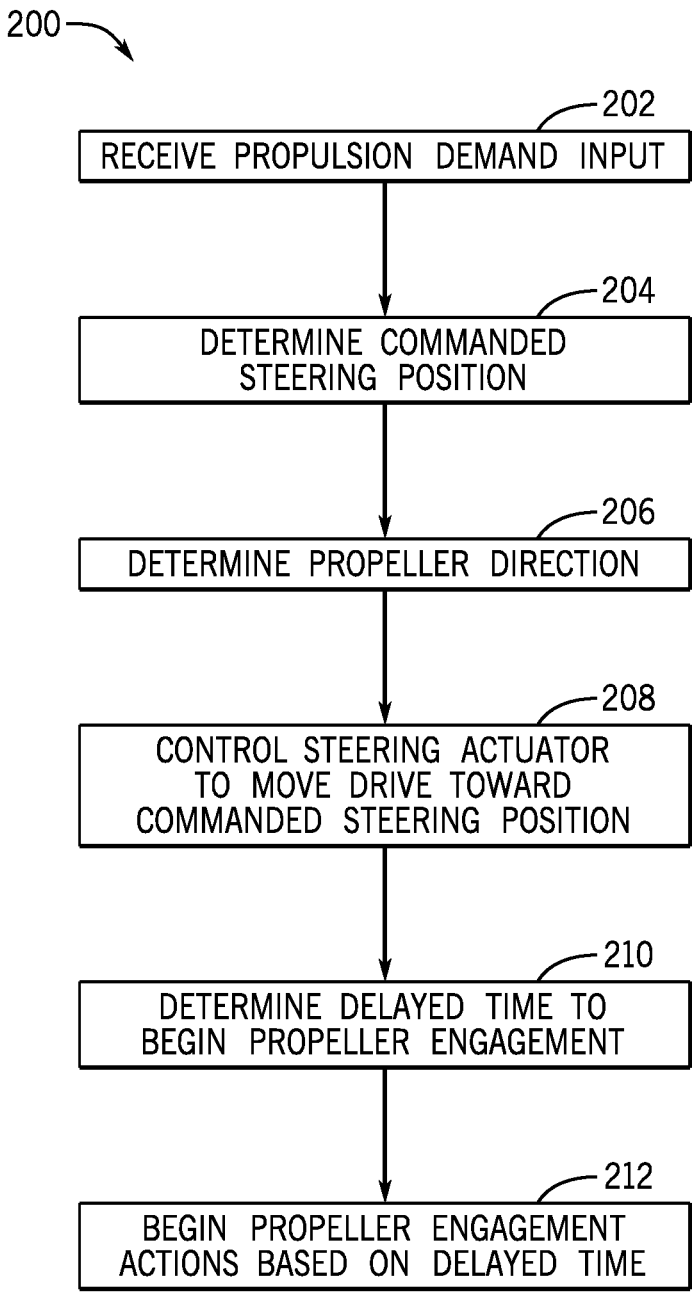
FIGS. 10-14 are flow charts depicting methods of controlling a marine propulsion system to control steering and shift in accordance with the present disclosure, or portions of such methods.

FIGS. 10-14 depict exemplary methods 200, 300, 400, 420, 460 of controlling a marine propulsion system to control steering and shift in accordance with the present disclosure, or portions of such methods. FIG. 10 depicts one embodiment of a method 200 wherein steering and thrust outputs are coordinated so that only the commanded thrust is effectuated. Once the propulsion demand input is received at step 202, a commanded steering position is determined at step 204 and a propeller direction is determined at step 206. A thrust magnitude may also be determined (not shown here). Methods and systems for calculating commanded steering position, as well as propeller direction and thrust magnitude commands, for drives in various marine propulsion system configurations based on a user input or other navigation command are known in the art, such as variously exemplified and described in several patents incorporated by reference above, including U.S. Pat. Nos. 7,467,595; 9,039,468; 10,926,855; 11,247,753, and U.S. application Ser. No. 17/869,515. For example, the propulsion system 100 may be configured with a velocity-based control system 33 where the user inputs are correlated with inertial velocity values for the marine vessel. In one such embodiment, the control system may be a model-based system where the steering and thrust outputs are determined based on modeled vessel behavior that accounts for the vessel dimensions and the locations and thrust capabilities of each of the lateral and rear marine drives. Alternatively, the control system 33 may be configured to utilize a map relating joystick positions to steering and thrust outputs, including magnitude and forward/reverse direction, for each marine drive in the propulsion system 100.

The steering actuator 13 for each steerable drive(s) 21, 22 is controlled at step 208 to move the drive toward the commanded steering position. The delayed time to begin propeller rotation is also determined, as represented at step 210. The marine drive is then controlled at step 212 to trigger the propeller engagement action based on the delayed time while the marine drive is still being steered toward the commanded steering position, thereby to initiate rotation of the propeller in the propeller direction immediately upon the commanded steering position being reached. The delayed time is determined to account for the specifics of the marine drive 21, 22 configuration and the amount of time it takes to perform the engagement action to commence propeller rotation. Exemplary steps for calculating the delayed time are illustrated and described with respect to FIGS. 12 and 13.

Figure 11:
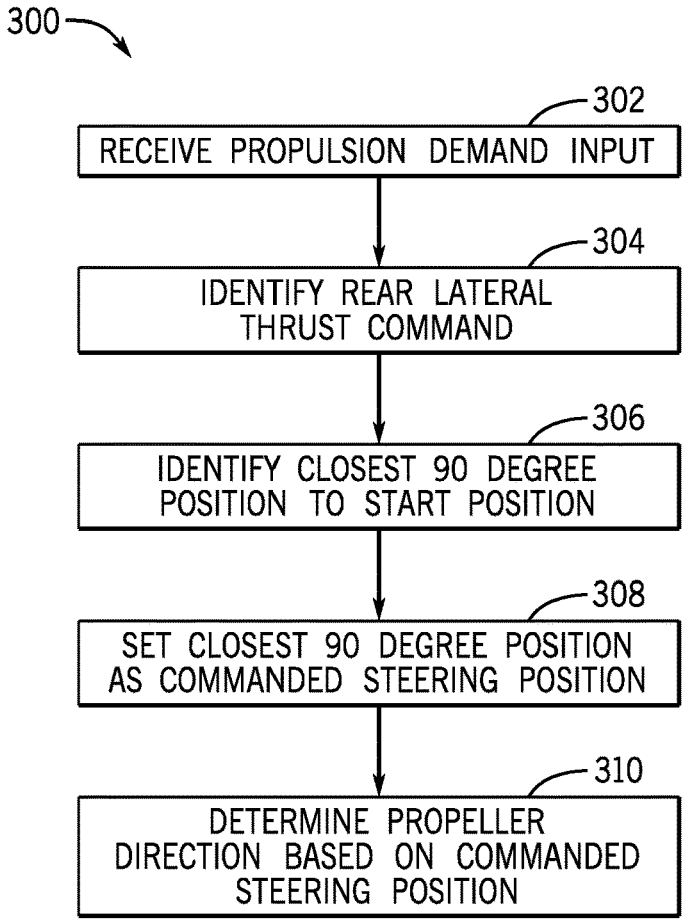

FIG. 11 depicts exemplary method 300 that may be executed to determine the commanded steering position for effectuating lateral thrust with a drive that is rotatable to a 90 degree steering position, and for determining the propeller direction accordingly. These steps for determining which direction to rotate the marine drive 21, 22 to the closest 90 degree steering position may be executed independently of the delayed time for coordinating propeller rotation and steering. Similarly, the delayed time calculations may be executed independently of the steering direction determination. Alternatively, the two control methods may be executed together to provide a more optimized performance for engaging lateral thrust with drives that are rotatable to a 90 degree steering position.

The propulsion demand input is received at step 302 commanding lateral thrust, and the lateral thrust command for rear propulsion is identified at step 304 requiring that the marine drive 21, 22 be rotated to the 90 degree steering position to generate lateral thrust at the stern of the vessel 10. Step 306 is executed to identify the closest one between the +90 degree steering position and the −90 degree steering position (i.e., whether the drive will reach a magnitude of 90 degrees from the centered steering position faster by rotating clockwise or counterclockwise). The closest 90 degree steering position is set as the commanded steering position at step 308, and the propeller direction is then determined at step 310 based on the commanded steering position. Additionally, an adjustment to the output command to the marine drive may be adjusted to account for the rotational direction and differences in drive operation or efficiencies between forward and reverse thrust directions, such as where the propeller is less efficient in one rotational direction than in the other. The steering actuator is controlled to move the marine drive to the steering position and the propeller rotation is engaged in the propeller direction, as described above.

Figure 12:
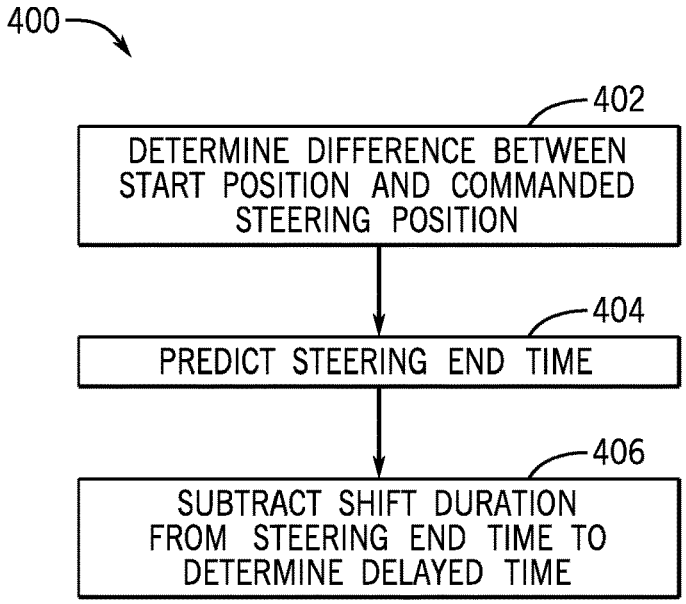

FIG. 12 exemplifies a method 400 for calculating the delayed time for a marine drive. Step 402 is performed to determine a difference between the start position of the marine drive before initiating the steering action and the commanded steering position, thus determining the rotational distance that the drive must travel to reach the commanded steering position. The steering end time is then predicted at step 404 based on the rotational distance instructed by the steering command. For example, the steering end time may be predicted based on the magnitude of the rotational distance and a known steering rate, or rate of turn, of the marine drive 21, 22 about the steering axis. For example, the known steering rate may be a calibratable value inputted based on the capabilities and configuration of the steering actuator—i.e., how fast the steering actuator operates to turn the drive. Alternatively or additionally, the steering end time may be predicted based on steering position measurements as the marine drive 21, 22 is moved toward the commanded steering position—e.g., the measured rate of rotation of the marine drive 21, 22 and the remaining amount that the drive 21, 22 needs to be turned to reach the commanded steering position.

Step 406 is then executed to determine the delayed time to begin propeller rotation based on the steering end time and the amount of time it takes to engage the propeller shaft and begin rotating the propeller, referred to herein as a shift duration. For example, the delayed time may be the steering end time minus the shift duration. Where the powerhead 121, 122 engages the propeller shaft through a transmission or a clutch and thus the engagement action includes shifting the transmission or clutch, the shift duration is the amount of time it takes to shift the transmission or clutch to the desired gear position. Where no transmission is included, the shift duration is based on the amount of time needed to start the rotation (e.g., start the electric motor), which may be a very short duration or zero time such that the propeller engagement action will commence upon the marine drive reaching the commanded steering position. In such an embodiment, the delayed time may be just before or at the steering end time. The respective marine drive 21, 22 is then controlled to trigger the propeller engagement action(s) based on the delayed time.

Figure 13:
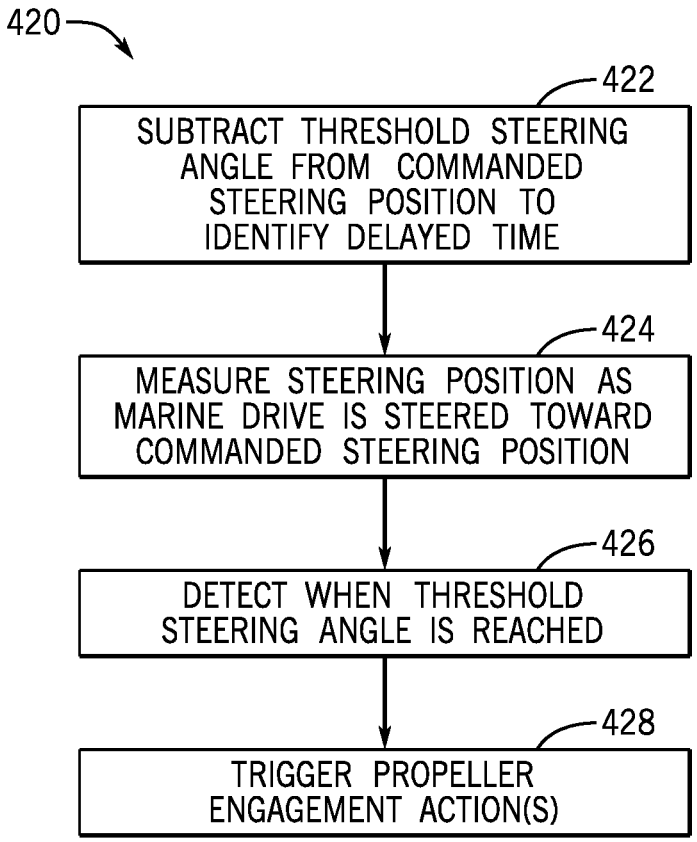

FIG. 13 exemplifies another method 420 of calculating the delayed time. Here, the delayed time to begin propeller engagement actions is based on steering position measurements and a calibrated value. The control system accesses a calibrated value enabling determination of a threshold steering angle between a start position and a commanded steering position where the propeller engagement actions (such as shifting the transmission and/or energizing the electric motor) should commence. For example, the calibrated value may be a threshold steering angle that is a steering-angle-equivalent of the shift duration—i.e., an amount of steering angle change that is expected to occur in the shift duration, such as based on the steering actuation speed. Alternatively, the calibrated value may be zero and thus the propeller engagement action will commence upon the marine drive reaching the commanded steering position.

The threshold steering angle is subtracted from the commanded steering position to determine the delay time at step 422. Represented at step 424, the steering position of the marine drive 21, 22 is then measured as the marine drive 21, 22 is steered toward the commanded steering position. The measured steering position of each of the marine drives 21, 22 are reported periodically and continually as the respective drive 21, 22 is moved toward the commanded steering position, such as at a sufficient frequency to coordinate the propeller engagement action with the steering end time. Once the threshold steering angle is reached at step 426, the propeller engagement actions are triggered at step 428 so that the propeller engagement action will complete and the propeller will begin rotating at the same time that the drive 21, 22 reaches the commanded steering position.

In some embodiments, the delayed time may be determined based on a combination of a a steering end time prediction and real-time steering position measurements. For example, the delayed time may be determined as both a predicted steering end time and a threshold steering position such that the steering engagement action is initiated upon reaching either the predicted steering end time or the measured steering position reaching the threshold steering position. Again, the threshold steering position may be a threshold steering angle ahead of the commanded steering position or may be the commanded steering position.

Figure 14:
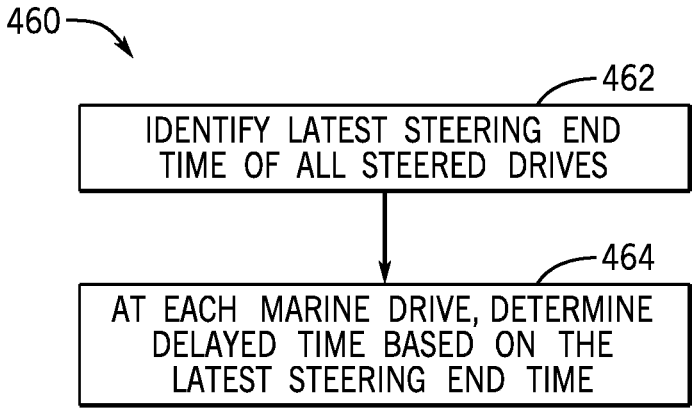

FIG. 14 exemplifies another method 460 of calculating the delayed time in a multi-drive system. Where the delay time is calculated for each of a plurality of marine drives 15, 21, 22, such as via any of the methods described above, steps may be executed to coordinate propeller engagement of all of the marine drives based on the drive that will take the longest to reach its steering position. In the example in FIG. 14, a steering end time is predicted for each of the steered drives in the propulsion system, and the latest steering end time is identified at step 462. Step 464 is then executed to determine the delayed time to begin the propeller engagement actions based on the latest steering end time.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method of controlling a marine propulsion system for a marine vessel, wherein the marine propulsion system includes at least one rear marine drive steerable about a steering axis to a range of steering positions, the method comprising:

receiving a propulsion demand input commanding a surge movement, a sway movement, and/or a yaw movement of the marine vessel;

for each of the at least one rear marine drive:

determining a propeller direction and a commanded steering position based on the propulsion demand input;

controlling a steering actuator to steer the rear marine drive toward the commanded steering position;

determining a delayed time to begin propeller engagement to coordinate initiation of propeller rotation with the rear marine drive reaching the commanded steering position; and controlling the rear marine drive to begin rotating the propeller in the propeller direction based on the delayed time to generate the surge movement, the sway movement, and/or the yaw movement commanded.

2. The method of claim 1, further comprising predicting a steering end time when the at least one rear marine drive will reach the commanded steering position, and determining the delayed time based on the steering end time.

3. The method of claim 2, wherein the steering end time is predicted based on a known steering rate for the steering actuator and a difference between a start position and the commanded steering position.

4. The method of claim 2, wherein the delayed time is determined further based on a shift duration, wherein a shift duration is an amount of time required to engage and begin rotating the propeller.

5. The method of claim 2, wherein the steering end time is predicted based on steering position measurements of the rear marine drive as it approaches the commanded steering position.

6. The method of claim 2, further comprising:

measuring steering position of the marine drive as it approaches the commanded steering position;

wherein the delayed time is further determined based on the rear marine drive reaching a threshold steering angle with respect to the commanded steering position.

7. The method of claim 1, further comprising:

measuring steering position of the marine drive as it approaches the commanded steering position;

wherein the delayed time is determined based on the rear marine drive reaching a threshold steering angle with respect to the commanded steering position.

8. The method of claim 1, wherein controlling the rear marine drive to begin rotating the propeller at the delayed time includes commanding shift of a transmission or clutch based on the delayed time.

9. The method of claim 8, wherein the delayed time is based on a shift duration of the transmission or clutch.

10. The method of claim 1, wherein the marine propulsion system further includes a lateral marine drive positioned at a fixed angle on a bow region of the marine vessel and configured to generate lateral thrust on the marine vessel, further comprising:

determining a lateral thrust command for the lateral marine drive based on the propulsion demand input;

controlling the lateral marine drive based on the delayed time to coordinate initiation of the lateral thrust with the initiation of the propeller rotation of the rear marine drive.

11. The method of claim 1, wherein the marine propulsion system includes only one rear marine drive configured to be positioned along a centerline of the marine vessel.

12. The method of claim 1, wherein the marine propulsion system includes at least two rear marine drives, wherein the delayed time for each of the at least two rear marine drives is determined to initiate propeller rotation of all of the at least two rear marine drives at the same time correlated with a last one of the at least two rear marine drives to reach its commanded steering position.

13. The method of claim 1, wherein the at least one rear marine drive is configured to be steerable between a centered steering position and a +90 degree position and −90 degree position, and further comprising:

upon receiving a lateral thrust command, determining the commanded steering position as a closest one of the +90 degree position and the −90 degree position to a start position of the at least one rear marine drive and determining the propeller direction based on the commanded steering position.

14. The method of claim 1, wherein the propulsion demand input is received from at least one user input device, wherein the user input device is a joystick, a steering wheel, and/or a throttle lever.

15. A marine propulsion system for a marine vessel comprising:

at least one rear marine drive configured to generate forward and reverse thrusts, wherein the rear marine drive is steerable about a steering axis to a range of steering positions;

a control system configured to:

receive a propulsion demand input commanding a surge movement, a sway movement, and/or a yaw movement of the marine vessel;

for each of the at least one rear marine drive:

determine a propeller direction and a commanded steering position based on the propulsion demand input;

control a steering actuator to steer the rear marine drive toward the commanded steering position;

determine a delayed time to begin rotating the propeller to coordinate initiation of propeller rotation with the rear marine drive reaching the commanded steering position; and control the rear marine drive to begin rotating the propeller in the propeller direction at the delayed time to generate the surge movement, the sway movement, and/or the yaw movement commanded.

16. The system of claim 15, wherein the control system is further configured to predict a steering end time when the at least one rear marine drive will reach the commanded steering position, and determine the delayed time based on the steering end time.

17. The system of claim 16, wherein the steering end time is predicted based on a known steering rate for the steering actuator and a difference between a start position and the commanded steering position.

18. The system of claim 16, wherein the delayed time is determined based on a shift duration, wherein a shift duration is an amount of time required to engage and begin rotating the propeller.

19. The system of claim 16, wherein the steering end time is predicted based on steering position measurements of the rear marine drive as it approaches the commanded steering position.

20. The system of claim 15, wherein controlling the rear marine drive to begin rotating the propeller at the delayed time includes commanding shift of a transmission or clutch based on the delayed time, wherein the delayed time is based on a shift duration of the transmission or clutch.

21. The system of claim 15, wherein the at least one rear marine drive is configured to be steerable between a centered steering position and a +90 degree position and/or −90 degree position.

22. The system of claim 21, wherein the control system is further configured to:

upon receiving a lateral thrust command, determine the commanded steering position as a closest one of the +90 degree position and the −90 degree position to a start position of the at least one rear marine drive and determining the propeller direction based on the commanded steering position.

23. A marine propulsion system for a marine vessel comprising:

a rear marine drive configured to generate forward and reverse thrusts, wherein the rear marine drive is steerable about a steering axis to a range of steering positions between a centered steering position and a +90 degree position and/or a −90 degree position;

a lateral marine drive positioned at a bow region of the marine vessel and at a fixed angle with respect to the marine vessel, wherein the lateral marine drive is configured to generate lateral thrust on the marine vessel;

a user input device operable by a user to provide a propulsion demand input commanding surge movement, sway movement, and yaw movement of the marine vessel; and a control system configured to:

determine a propeller direction and a commanded steering position for the rear marine drive based on the propulsion demand input, and a lateral thrust command for the lateral marine drive based on the propulsion demand input;

control a steering actuator to steer the rear marine drive to the commanded steering position;

determine a delayed time to begin propeller engagement to coordinate initiation of propeller rotation with the rear marine drive reaching the commanded steering position; and control the rear marine drive and the lateral marine drive based on the delayed time to generate the surge movement, the sway movement, and/or the yaw movement commanded.

24. The system of claim 23, wherein the rear marine drive is configured to be steerable between the centered steering position and both the +90 degree position and the −90 degree position, and wherein the control system is further configured to, upon receiving a lateral thrust command, determine the commanded steering position as a closest one of the +90 degree position and the −90 degree position to a start position of the rear marine drive and determining the propeller direction based on the commanded steering position.

* * * * *